US005092751A

United States Patent [19]

Viktora

[11] Patent Number: 5,092,751

[45] Date of Patent: Mar. 3, 1992

[54] SPLIT GEAR PUMP MECHANISM WITH GEAR OFFSET

[76] Inventor: Dean C. Viktora, 2415 Hopecrest Dr., Charlotte, N.C. 28210

[21] Appl. No.: 604,697

[22] Filed: Oct. 26, 1990

[51] Int. Cl.[5] ..... F04C 2/18

[52] U.S. Cl. ..... 418/1; 418/200; 418/201.3

[58] Field of Search ..... 418/200, 201.3, 206, 418/1

[56] References Cited

U.S. PATENT DOCUMENTS

| | | | |
|---|---|---|---|
| 621,280 | 3/1899 | Pitt | 418/200 |
| 2,236,980 | 4/1941 | Ungar | 418/200 |
| 2,382,042 | 8/1945 | Etnyre | 418/200 |
| 2,982,221 | 5/1961 | Whitfield | 418/200 |
| 3,272,140 | 9/1966 | Curry et al. | 418/200 |
| 4,277,230 | 7/1981 | Müller | 418/200 |
| 4,761,125 | 8/1988 | Inagaki et al. | 418/201.3 |
| 4,907,954 | 3/1990 | Slupski | 418/200 |

FOREIGN PATENT DOCUMENTS

| | | | |
|---|---|---|---|
| 973994 | 7/1960 | Fed. Rep. of Germany | 418/200 |
| 820620 | 11/1937 | France | 418/200 |
| 324979 | 2/1930 | United Kingdom | 418/200 |

*Primary Examiner*—Richard A. Bertsch
*Assistant Examiner*—David L. Cavanaugh
*Attorney, Agent, or Firm*—Ralph H. Dougherty

[57] ABSTRACT

The invented split gear mechanism replaces a standard single spur gear used within metering pumps and operates in conjunction with a similar driven split gear mechanism. The invention includes two or more layered gear pairs, each layer being re-indexed at a slightly altered fixed orientation relative to a given index point. The invention is typically used within "precision metering pumps" used, for example, in the textile industry. The invention facilitates uniformity by reducing pulsations generated by existing pumps. A method for reducing pulsations in pumping tasks is also included.

5 Claims, 2 Drawing Sheets

Fig. 1
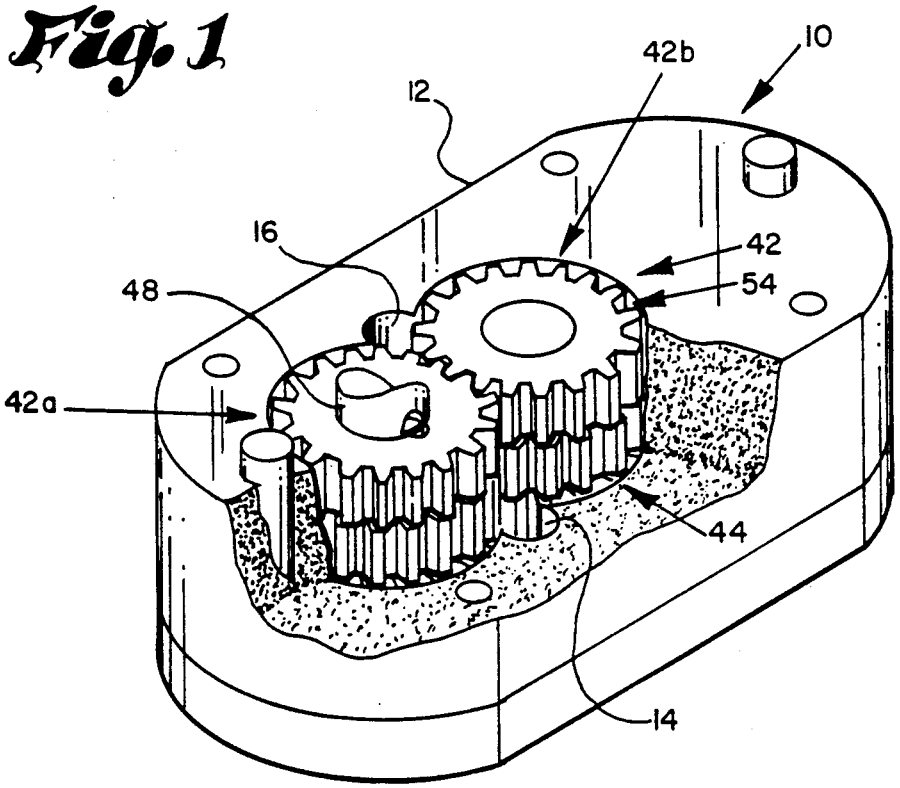
Related Art
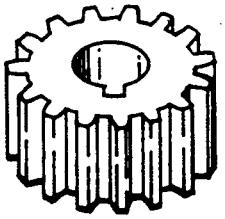
Fig. 2
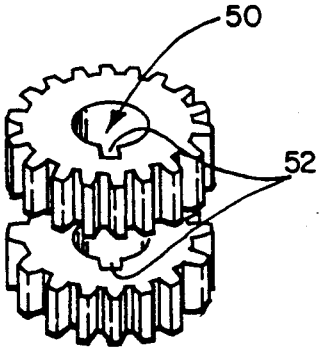
Fig. 3
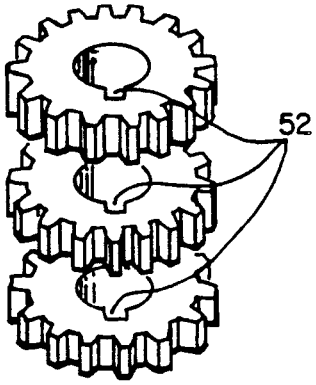
Fig. 4

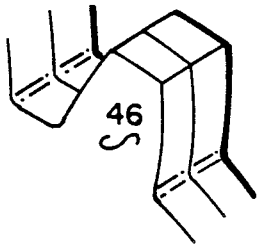
Fig. 6
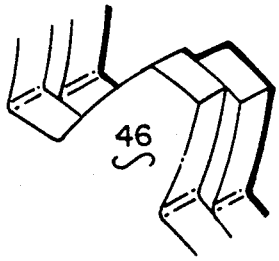
Fig. 7
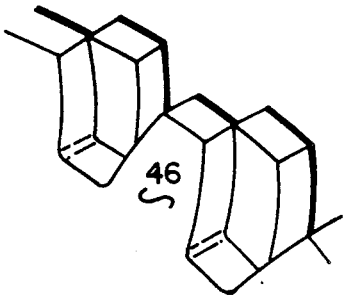
Fig. 8
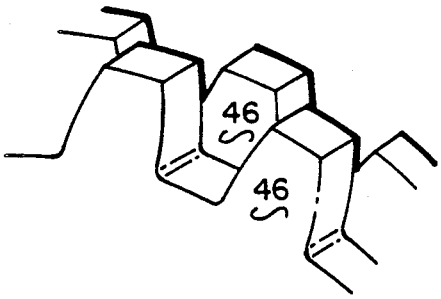
Fig. 9
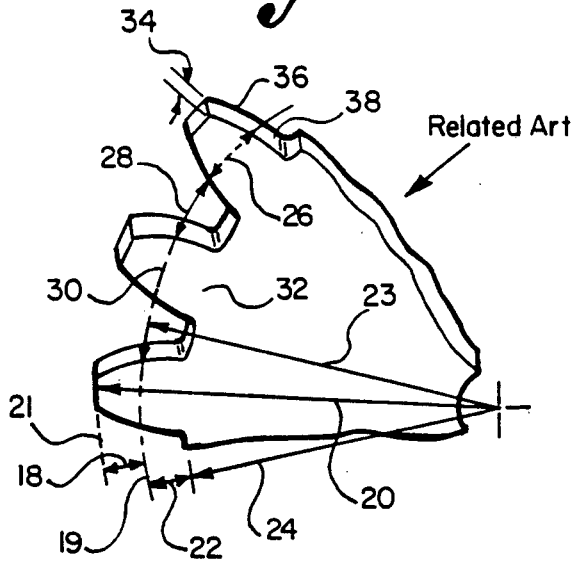
Fig. 5
Fig. 10
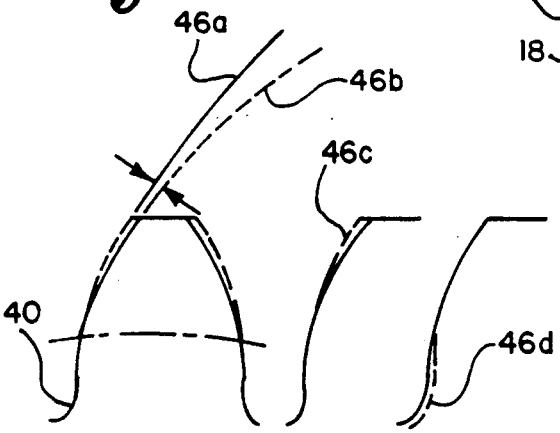

SPLIT GEAR PUMP MECHANISM WITH GEAR OFFSET

BACKGROUND OF THE INVENTION

1. Field of the Invention

The present invention relates generally to metering gear pumps, and more particularly to spur gear mechanisms, which are used within gear pumps for pumping and measuring tasks. A method for reducing pulsations in pumping tasks is also included.

2. Description of Related Art

Gear pumps belong to a class of devices known as continuous displacement devices which are used to increase and decrease pressure in a system. Metering (or dosimetric) pumps are a subtype of gear pumps and are used to quantitatively measure certain aspects of the system. Gear pumps and metering pumps have long been in use and are commonplace throughout a variety of industries today.

As used throughout this specification and appended claims, the following gear-related terms have the meanings indicated:

"Addendum" means the radial distance from the pitch circle to the outside circle of the gear.

"Addendum radius" means the maximum radius of the gear (pitch radius plus addendum).

"Dedendum" means the radial distance from pitch circle to bottom of space between teeth.

"Dedendum radius" means the radius of circle defining bottom of space between teeth (pitch radius minus dedendum).

"Tooth width" means the arc of pitch circle subtending width of a tooth.

"Space width" means the arc of pitch circle subtending space between teeth.

"Circular pitch" means the segment of arc of pitch circle assigned to one tooth and one space.

"Diametral pitch" means the number of teeth on a gear divided by its pitch diameter.

"Face of gear" means the thickness of the gear measured parallel to the axis of rotation.

"Face of tooth" means the contacting surface of tooth from pitch circle to addendum circle.

"Flank of tooth" means the contacting surface of tooth from pitch circle to dedendum circle.

"Fillet" means the rounded corner between flank and dedendum circle.

A wide variety of gear types exist. Spur gears, for example, have teeth on their outer circumference which are parallel to the axis of rotation. Annular gears teeth positioned around the interior surface of ring. Bevel, helical (including herringbone), spiral, and worm gears are additional types of gearing mechanisms. Disadvantages exist with respect to each of the specified gearing mechanisms. Helical gear systems generate an undesirable axial thrust component which causes both a given side plate and a gear to become worn, resulting in an undesirable increased side clearance between the side plate and the gear. In addition, precision grinding is expensive. Although herringbone gear systems generate no axial thrust, they are also expensive to precision grind. Herringbone gear teeth are also subject to distortion at high temperatures which can result in ineffective sealing between teeth. Single spur gear systems do not generate axial thrust but do create unwanted pulsations during the engagement of each successive tooth and fillet.

Gear pumps function by moving matter, typically liquid, in each fillet around the periphery of the gear and expelling it by engagement of the tooth of the adjacent gear into the fillet at the point of engagement. A continuous seal is formed between the mating teeth. Minimal side and tip clearances prevent the travel of significant quantities of liquid from the high pressure side to the low pressure side of the pump. Gear pumps may employ different types of gears and may be configured in a variety of ways (e.g., multiple-gear, planetary, staged or tandem).

Measuring pumps are utilized in continuous extrusion process systems such as fiber, film, form and wire extrusion, perfume, and additive chemical production. Form and wire extrusion is a type of profile extrusion whereby the output of the measuring pump is formed by creating a pre-determined shape surrounding a wire(s) and/or a continuous extruded form. These applications require that pulsations be kept to a minimum. In addition, since high amplitude pulsations emit detectable amounts of acoustical energy, minimal pulse pumps are required in specialized hydraulic systems used in marine applications.

Applicant is aware of the following U.S. Patents concerning gear pumps generally.

| U.S. Pat. No. | INVENTOR | ISSUE DATE | TITLE |
|---|---|---|---|
| 3,272,140 | Curry et al. | 09/13/1966 | METERING PUMP |
| 4,761,125 | Inagaki et al. | 08/02/1988 | TWIN-SHAFT MULTILOBED TYPE HYDRAULIC DEVICE |
| 4,907,954 | Slupski | 03/13/1990 | MULTIPLE LOBED PISTON PUMP WITH ANGULARLY AND AXIALLY DISPLACED SEGMENTS AND THROTTLE VALVE |
| 621,280 | Pitt | 03/14/1899 | ROTARY PUMP |

Curry relates to a positive displacement metering pump with a metered output stream which is purported to be substantially free of pulsations. The pumping apparatus comprises a gear pump housing having an inlet port, first and second pairs of meshed gears within the housing, and means for defining a common discharge port for the output streams of the first and second pairs of gears. The second pair of gears is aligned with respect to the first pair of gears so that the teeth of the second pair of gears are angularly displaced one-fourth pitch with respect to the corresponding teeth on said first pair of gears.

Curry's first embodiment includes a separator plate between pairs of gears. He states that in a second embodiment the plate could be eliminated "if each tooth tip extends over an arc of at least one-fourth of the pitch angle, so that each tooth overlaps the corresponding tooth on the adjacent gear on the same shaft over their entire depths, when viewed parallel to the axis about which the gears revolve." Although Curry's disclosure is somewhat ambiguous, it appears that he proposed either or both of the following: (1) the teeth on adjacent gears be displaced one-fourth of the pitch angle (i.e., the angle defined by lines connecting corresponding points on adjacent teeth with the gear center) with respect to each other; and (2) the tips of the teeth extend over an arc on the gear circumference of at least one-fourth of the pitch angle. Proposition (1) is equivalent to suggesting that the teeth on adjacent gears be displaced as shown in FIG. 8 herein, that is, aligning one, and only one, intersecting edge of a tooth tip and face of a tooth with one intersecting edge of a tooth tip and face of a tooth of an adjacent gear. Experimentation reveals that this configuration does not form an adequate seal to function as a gear pump and is consequently non-functional for reducing pulsations in dosimetric pumps. Proposition (2) amounts to imposing a constraint on the size of the teeth of a gear relative to pitch angle. The present invention imposes no such restraint.

Inagaki et al. teaches a twin-shaft multi-lobed type hydraulic device, such as a device used as a compressor for a vehicle air-conditioner or as an air pump.

Slupski relates generally to rotary positive displacement pumps. The object is to reduce the vibration and noise output of such pumps. Slupski includes cooperating pistons having segments which are angularly displaced from each other. Slupski appears to be limited to pumps which include a separator plate between the gear pairs.

Pitt relates to pumps, and more particularly to that type of pump which embodies intermeshing gears or pistons arranged in pairs and suitably encased, the casing having an induction-port in its bottom and an eduction-port in its top. This patent is mentioned for the purpose of full disclosure, but clearly it is not directly relevant to the present invention.

None of the aforementioned related art patents appear to disclose the structure, operation, and result of the present invented split gear pump. In particular, none of the patents disclose at least two pairs of meshed gears, each pair of gears (first pair) being so aligned with respect to at least one adjacent pair of gears (second pair) that the teeth of the second pair are angularly displaced less than one-fourth pitch with respect to the corresponding teeth on the first pair.

SUMMARY OF THE INVENTION

The invented split gear mechanism replaces a standard single spur gear used within metering pumps and operates in conjunction with a similar driven split gear mechanism. The invention includes two or more layered spur gear pairs, each layer being re-indexed at a slightly altered fixed orientation relative to a given index point.

The orientation is dependent upon the tooth tip width and is limited by the metal-to-metal seal generated at the tooth tip between gear layers. The drive gears are indexed to a predetermined orientation through a common drive mechanism (e.g., key, press fit, shrink fit, and/or bonding or fusing). At least two pairs of meshed gears, each pair of gears (first pair) are aligned with respect to at least one adjacent pair of gears (second pair) that the teeth of the second pair are angularly displaced less than one-fourth pitch with respect to the corresponding teeth of the first pair. The orientation of one gear layer to the other must be very specific in order to maintain seal integrity between the tooth layers. Improper orientation causes pressure leakage to the low pressure side of the unit.

The invention is particularly useful in the spinning of continuous denier fiber. Additionally, with the advent of ultrafine denier or micro denier, standard gear pumps produce pulsations which unduly limit the minimum fiber thickness and the maximum machine speed. By significantly reducing the pulsation amplitude, approximating a uniform pressure curve, the invention permits fibers producers to economically produce low denier fibers. In film production, the invented split gear pump also eliminates film striations caused by pulsations during the extrusion process. In additive systems such as dyes, antioxidants, and pharmaceutical systems, greater control and proportionality can be achieved. The invention may also be advantageously used on aircraft and marine vehicles to provide ultra-quiet hydraulic control systems.

OBJECTS OF THE INVENTION

The principal object of the invention is to provide a split gear pump apparatus which minimizes pulsations per pump revolution to an insignificant level.

Another object of the invention is to provide a split gear pump device which exhibits no axial thrust component.

Another object of the invention is to provide a split gear pump device which is inexpensive and easy to install in existing pumps.

A further object of the invention is to provide a split gear pump apparatus which is easy to install and easy to maintain.

Another object of the invention is provide a split gear pump apparatus which enables reduction in the number of teeth per gear, thus increasing the pump capacity per rotation, while maintaining a significantly pulse-free discharge stream.

BRIEF DESCRIPTION OF THE DRAWINGS

The foregoing and other objects will become more readily apparent by referring to the following detailed description and the appended drawings in which:

FIG. 1 is a perspective view of the invented split gear pump mechanism, with a portion broken away to illustrate the gear configuration.

FIG. 2 is a perspective view of a standard prior art spur gear.

FIG. 3 is a perspective view of an improved embodiment for a spur gear.

FIG. 4 is a perspective view of an alternative embodiment for the spur gear illustrated in FIG. 3.

FIG. 5 is an isometric view of a portion of a prior art gear, illustrating various portions of a standard spur gear.

FIG. 6 is a perspective view of two teeth of two gears oriented to completely overlap one another.

FIG. 7 is a perspective view of two teeth of two gears oriented to partially overlap on another.

FIG. 8 is a perspective view of two teeth of two gears oriented to minimally overlap one another.

FIG. 9 is a perspective view of two teeth of two gears rotated to a non-overlap orientation.

FIG. 10 is a side view of a gear tooth illustrating both a conjugate curve shape and modified conjugate curve shapes.

DETAILED DESCRIPTION

Referring now to the drawings, and particularly to FIG. 1, the invented split gear pump mechanism 10 includes a gear pump housing 12 having an inlet port 14 and an outlet port 16.

The housing 12 contains at least two pairs of meshed gears 42, 44, having teeth 46 thereon. The form of the teeth may be conjugate curves 4*a* or modified conjugate curves 46*a*, 46*c*, 46*d*, as shown in FIG. 10. For each pair of meshed gears 42, one gear is designated as the driven gear 42*a* and the other is designated as the idler gear 42*b*. Preferably, the meshed gears 42 are spur gears, but other types of gears may also be employed. The thickness of each pair of meshed gears 42 is advantageously selected to maximize the number of meshed gear pairs 42 that can fit within a pre-determined housing 12 for a particular application. Each pair of gears is aligned with respect to at least one adjacent pair of gears (first pair) 42 so that the teeth 46 of the second pair 44 are angularly displaced less than one-fourth pitch with respect to the corresponding teeth 46 on the first pair 42. In other words, each pair of gears is aligned with respect to at least one adjacent pair of gears so that the teeth of the second pair form fluid seal overlap between the first pair and the second pair of gears. In addition, all driven gears 42*a* are vertically adjacent and all idler gears 42*b* are vertically adjacent. A common discharge port for the output streams of the pairs of gears includes an outlet port 16. The device enables reduction in the number of teeth per gear, thereby increasing the pump capacity per rotation, while maintaining a significantly pulse-free discharge stream.

In operation, at least two pair of meshed gears 42 are provided. Each adjacent pair of gears is then oriented with respect to an adjacent pair of gears to form a fluid seal overlap between the two pairs, as in FIG. 7. Each gear layer is reindexed at a slightly altered fixed orientation relative to one index point. The drive gears are indexed to a pre-determined orientation through a common drive mechanism (e.g., key, press fit, shrink fit, and/or bonding or fusing). See FIG. 4. The preferred embodiment is to provide each gear intended to be driven with a groove or channel 52 machined into its interior wall, parallel to the axis of intended rotation, adapted for engagement with means for driving the gear. The set of meshed gears 42 include standard means for driving the gears. The driving means includes a drive member 48 adapted to fit within a drive shaft 50 defined by the drive gears 42*a*, and to mate with the groove, channel, or the like 52. The layered gear pairs 42 are housed in a standard gear housing 12 having an interior wall 54, adapted for receiving the meshed gears 42, and inlet and outlet ports 14, 16. Fluid is forced through the inlet port 14 and makes contact with the layered gears. The gears are driven such that portions of the liquid are carried around the interior wall of the housing 12, in the fillets of the gears, from the inlet port 14 to the outlet port 16. The liquid is expelled by engagement of the tooth of the adjacent gear into the fillet at the point of engagement. A continuous seal is formed between the mating teeth. Minimal side and tip clearances prevent significant quantities of liquid to travel from the high pressure side to the low pressure side of the pump. The fluid seal overlap between adjacent pairs of gears results in reduced pulsations within the gear mechanism.

Several gear-related terms are illustrated in FIG. 5. The addendum 18 is the radial distance from the pitch circle 19 to the outside circle of the gear 21. The addendum radius 20 is the maximum radius of the gear (pitch radius 23 plus addendum). The dedendum 22 is the radial distance from the pitch circle to the bottom of the space between teeth. The dedendum radius 24 is the radius of the circle defining the bottom of the space between the teeth (pitch radius minus dedendum). The tooth width 26 is the arc of pitch circle subtending the width of a tooth. The space width 28 is the arc of pitch circle subtending the space between teeth. The circular pitch 30 is the segment of arc of the pitch circle assigned to one tooth and one space. The diametral pitch is the number of teeth on a gear divided by its pitch diameter. The face of gear 34 is the thickness of the gear measured parallel to the axis of rotation. The face of tooth 36 is the contacting surface of tooth from pitch circle to addendum circle. The flank of tooth 38 is the contacting surface of tooth from pitch circle to dedendum circle. The fillet 40 is the rounded corner between the flank and dedendum circle 32.

SUMMARY OF THE ACHIEVEMENT OF THE OBJECTS OF THE INVENTION

From the foregoing, it is readily apparent that I have invented an improved apparatus for providing a gear apparatus which minimizes pulsations per pump revolution to an insignificant level, exhibits no axial thrust component, which enables reduction in the number of teeth per gear, thus increasing the pump capacity per rotation, while maintaining a significantly pulse-free discharge stream, which is inexpensive and easy to install in existing pumps, and which is easy to install and easy to maintain.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

I claim:

1. A pump apparatus for producing a substantially constant flow, comprising:
   (a) a gear pump housing having an inlet port;
   (b) at least two pairs of meshed gears, having teeth thereon, within said housing;
   (c) each pair of gears (first pair) being so aligned with respect to at least one adjacent pair of gears (second pair) that the teeth of said second pair are angularly displaced, such angular displacement being less than one-fourth pitch with respect to the corresponding teeth on said first pair, wherein the teeth of a given first pair and the teeth of an adjacent second pair form a fluid seal overlap between the two pairs; and
   (d) a common discharge port for the output streams of said pairs of gears.

2. Apparatus according to claim 1, wherein the form of said teeth of said pairs of gears are conjugate curves.

3. Apparatus according to claim 1, wherein the form of said teeth of said pairs of gears are modified conjugate curves.

4. Apparatus according to claim 1, wherein said meshed gears are drawn from the group consisting of spur gears, annular gears, bevel gears, helical gears, herringbone gears, spiral gears, and worm gears.

5. Method for producing a substantially constant flow, comprising the steps of:
   (a) providing at least two pair of meshed gears, having teeth thereon, the teeth defining fillets;
   (b) providing each gear intended to be driven with a means for engaging the driving means;
   (c) providing means for driving the meshed gears;

(d) orienting each pair of meshed gears with respect to an adjacent pair of gears to form a fluid seal overlap between the two pairs, thereby creating layered gear pairs;

(d) housing the layered gear pairs in a standard gear housing having inlet and outlet ports, and an interior wall, the interior wall adapted for receiving the meshed gears with minimal clearance between the interior wall and the meshed gears;

(e) forcing fluid through the inlet port, thus making contact with the layered gears;

(f) driving the meshed gears such that portions of the fluid are carried around the interior wall of the housing, in the fillets of the gears, from the inlet port to the outlet port;

(g) expelling the fluid by engagement of the tooth of the adjacent gear into the fillet at the point of engagement, whereby the fluid seal overlap between adjacent pairs of gears results in reduced pulsations.

* * * * *

UNITED STATES PATENT AND TRADEMARK OFFICE

CERTIFICATE OF CORRECTION

PATENT NO. : 5,092,751

DATED : March 3, 1992

INVENTOR(S) : Dean C. Victora

It is certified that error appears in the above-indentified patent and that said Letters Patent is hereby corrected as shown below:

Column 4, line 52, change "on" to "one";

Column 4, line 68, change "4a" to "46a".

Signed and Sealed this

Twenty-fifth Day of August, 1998

Bruce Lehman

*Attest:*

BRUCE LEHMAN

*Attesting Officer*

*Commissioner of Patents and Trademarks*